US009539590B2

(12) United States Patent
Vorel

(10) Patent No.: US 9,539,590 B2
(45) Date of Patent: Jan. 10, 2017

(54) SPRAY HEAD

(71) Applicant: Grohe AG, Hemer (DE)

(72) Inventor: Thomas Vorel, Arnsberg (DE)

(73) Assignee: Grohe AG, Hemer (DE)

( * ) Notice: Subject to any disclaimer, the term of this patent is extended or adjusted under 35 U.S.C. 154(b) by 26 days.

(21) Appl. No.: 13/854,701

(22) Filed: Apr. 1, 2013

(65) Prior Publication Data

US 2013/0214064 A1 Aug. 22, 2013

Related U.S. Application Data

(63) Continuation of application No. PCT/EP2010/006005, filed on Oct. 1, 2010.

(51) Int. Cl.

| | |
|---|---|
| ***B05B 7/04*** | (2006.01) |
| ***B05B 1/12*** | (2006.01) |
| ***B05B 1/16*** | (2006.01) |
| ***B05B 1/18*** | (2006.01) |

(52) U.S. Cl.

CPC ..... *B05B 1/12* (2013.01); *B05B 1/1681* (2013.01); *B05B 1/18* (2013.01); *B05B 7/0408* (2013.01); *B05B 7/0416* (2013.01)

(58) Field of Classification Search

CPC .... B05B 7/0815; B05B 7/0408; B05B 7/0416; F23D 14/42; F23D 11/10; F23D 14/04; E03C 1/084

USPC ..... 239/8, 335, 418, 419, 419.5, 419.3, 420,239/421, 422, 423, 424, 425, 425.5, 427.3,239/427.5, 428, 398, 407, 428.5, 569, 548–568

See application file for complete search history.

(56) References Cited

U.S. PATENT DOCUMENTS

| | | | | |
|---|---|---|---|---|
| 5,213,267 | A | 5/1993 | Heimann et al. | |
| 5,918,816 | A * | 7/1999 | Huber | B05B 1/1618 239/391 |
| 5,937,905 | A | 8/1999 | Santos | |
| 6,715,699 | B1 * | 4/2004 | Greenberg et al. | 239/394 |
| 6,869,030 | B2 * | 3/2005 | Blessing et al. | 239/394 |
| 7,017,837 | B2 * | 3/2006 | Taketomi et al. | 239/428.5 |
| 7,520,448 | B2 * | 4/2009 | Luettgen | B05B 1/1654 239/222.11 |
| 2003/0121993 | A1 * | 7/2003 | Haverstraw et al. | 239/443 |
| 2007/0158470 | A1 * | 7/2007 | Taylor | B05B 7/0425 239/428.5 |
| 2010/0264237 | A1 * | 10/2010 | Engel | 239/443 |

FOREIGN PATENT DOCUMENTS

| | | |
|---|---|---|
| DE | 29 19 734 B1 | 8/1980 |
| DE | 41 16 929 A1 | 11/1992 |
| DE | 43 41 196 A1 | 6/1994 |
| EP | 0 732 148 A2 | 9/1996 |
| EP | 1 616 628 A1 | 1/2006 |

* cited by examiner

*Primary Examiner* — Arthur O Hall
*Assistant Examiner* — Christopher R Dandridge
(74) *Attorney, Agent, or Firm* — Muncy, Geissler, Olds & Lowe, P.C.

(57) ABSTRACT

A spray head is provided that includes a housing having a water inlet, at least one water guide, and a housing bottom, in which jet outlet openings are arranged, wherein the water guide is used as a connection between the water inlet and a number of jet outlet openings and a valve element for sealing a valve opening is provided for the water guide. The valve element is movably mounted on both sides and a control device having at least one control element that acts on the valve element is provided, wherein the control element defines a translational movement of the valve element by a valve stroke.

23 Claims, 3 Drawing Sheets

SPRAY HEAD

This nonprovisional application is a continuation of International Application No. PCT/EP2010/006005, which was filed on Oct. 1, 2010, and which is herein incorporated by reference.

BACKGROUND OF THE INVENTION

Field of the Invention

The invention relates to a spray head.

Description of the Background Art

Different jet outlet openings are often provided in overhead or hand showers at the spray base to generate different spray patterns or spray types. A plurality of changeover devices are known for changing from one jet type to another.

SUMMARY OF THE INVENTION

A hand shower head for showers and baths with a water supply conduit and a spray head disposed rotatable at the water supply conduit are known from DE 41 16 929 A1, which corresponds to U.S. Pat. No. 5,213,267, which is incorporated herein by reference. The spray head has a seal disk with a plurality of openings and a plurality of jet nozzles generating spray jets, which can be connected selectively to the water supply conduit by rotating the spray head about its longitudinal axis.

In the conventional art, because a spray head here is basically rotated against the sealant provided at the seal disk, particularly in the case of stiffness of the spray head, wear of this sealant can occur as a result of which the spray head can leak.

A spray head with two water passageways, two different spray formers, and a changeover device in the form of a rocker switch, which is connected rigidly to spring-biased individual valves, is provided in U.S. Pat. No. 5,937,905 A, so that by pressing down on one valve in each case the other valve is raised and thus the water passageway to a spray pattern is released.

SUMMARY OF THE INVENTION

It is therefore an object of the invention to improve a spray head.

In an embodiment, the invention provides a spray head which has a housing comprising a water inlet, at least one water guide, and a housing bottom in which jet outlet openings are arranged. The water guide is used here as a connection between the water inlet and a number of jet outlet openings. Furthermore, a valve element for sealing a valve opening is provided for the water guide. According to an embodiment of the invention, the valve element is movably mounted on both sides. This means that only a radial mounting or guiding of the valve element is provided, so that it is freely movable about a path (x) in the operating direction of the valve or in the direction of the valve lift. To actuate the valve element, a control device having at least one control element acting on the valve element is provided, which defines a displacement of the valve element by a valve lift (y). The movable control device is provided as a separate part, which is only functionally connected to the valve element. A mechanical connection of the control device to the valve element is hereby avoided. The movable control device can be disposed in the housing between the water inlet and the housing bottom.

The housing bottom can have a number of jet outlet opening types to generate different jet patterns. In the case of different types of jet outlet openings, typically a water guide is assigned to each type of jet outlet openings. In this case, a valve element is provided per water guide.

As an alternative, also only one type or form of jet outlet openings can be provided, whose jet pattern can be varied by operating the control device. In this case as well, a number of water guides can be arranged each of which is connected to a number of the same jet outlet openings. A valve element is assigned in turn to each water guide.

In the spray head of the invention, depending on the position of the control element, in each case a valve opening is completely or partially released or closed by the valve element. This is determined by the arrangement of the control element on the control device and on its shape and height. The control device can therefore be provided as a mere changeover device between two or more jet patterns in that namely one or more water guides are unblocked or closed. Further, they can be used as a restricting and/or shut-off device. If only the water inflow is to be restricted with the control device, the valve lift (y) is defined so that the valve element in fact lifts off the valve seat but does not unblock the entire valve opening. A water saving mode at the spray head, for example, can be realized with this type of adjustment.

Advantageously, the valve element(s) in its (their) closed position is (are) acted on by water pressure and/or a spring element. During operation of the valve element by the control device, the valve element is raised by the valve lift (y) from the valve seat against a spring force or against a force generated by existing water pressure in the spray head. If a spring element is disposed at the valve element and the control device is moved further, so that the control element no longer acts on the valve element, it then returns again to its closed position.

If the valve element is pressed against the valve seat by the existing water pressure alone, it is again freely movable after the water is shut off at an associated sanitary fitting.

An embodiment of the invention provides that in addition, a valve element for supplying air is provided in the spray head. Apart from the water guides, a channel for air is then also provided in the housing of the spray head. The air is drawn in from the outside by means of a Venturi effect. To be able to mix the air with water in the water guide or in a mixing chamber, another valve element is provided for the drawn in air in the spray head. This valve element can be made structurally identical to the valve elements for the water guides. Apart from the generation of different jet patterns a further water saving mode can also be provided by the mixing in of air.

Moreover, each valve element can be controlled by the control device individually or in combination with at least one other valve element. This is achieved by the arrangement of the control element(s).

To this end, more than one control element per valve element can be provided, which during actuation of the control device act one after the other on the same valve element. As an alternative to this, a control element can be provided for a plurality of valve elements. In the last case, upon movement of the control device, the same control element works sequentially on a plurality of valve elements. In this regard, the valve elements can be arranged in series or offset to one another.

According to an embodiment of the invention, the control element(s) can be provided, for example, in the form of a cam, a pin, a rocker lever, or in the form of a recess.

To bring about a defined lift movement of the valve element, the control element of the control device should end up directly under the valve element. Hereby, the user needs to overcome only the force of a spring element or the force of water pressure acting on the valve element. It is of advantage here, when the control element or the control elements has/have bevels or curved or guide tracks for the continuous adjustment of the valve lift. Because of the bevels, it becomes even simpler for the user to operate the control device, because no resistances in the form of offsets need to be overcome. Different flow volumes per jet pattern can be adjusted thereby via the continuous adjustment of the valve lift and the previously described restriction function of the control device.

An embodiment of the invention provides that a disk is provided as the control device and a control element arranged perpendicular to the disk plane as the control element. In this regard, the disk can be rotated about an axis arranged perpendicular to the housing bottom or about an axis arranged parallel to the valve element axis. One or more control elements can be arranged on the disk. If a plurality of control elements are arranged in the radial and/or tangential direction, a variety of possible variations result for adjustability for the associated valve elements.

A further embodiment of the invention provides that a disk movable in a translational manner is provided as the control device. Here as well, the control elements are arranged perpendicular to the disk plane. As an alternative thereto, the valve elements can be arranged not only perpendicularly but also horizontally or at an inclination in the spray head. In the case of horizontally arranged valve elements, a circular ring or a cylindrical element can be provided as the control device. The control elements are then oriented radially inwardly or outwardly and also act on the valve elements in their lift direction.

According to another embodiment of the invention, a camshaft can also be provided as the control device.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitive of the present invention, and wherein.

DETAILED DESCRIPTION

Figure 1:
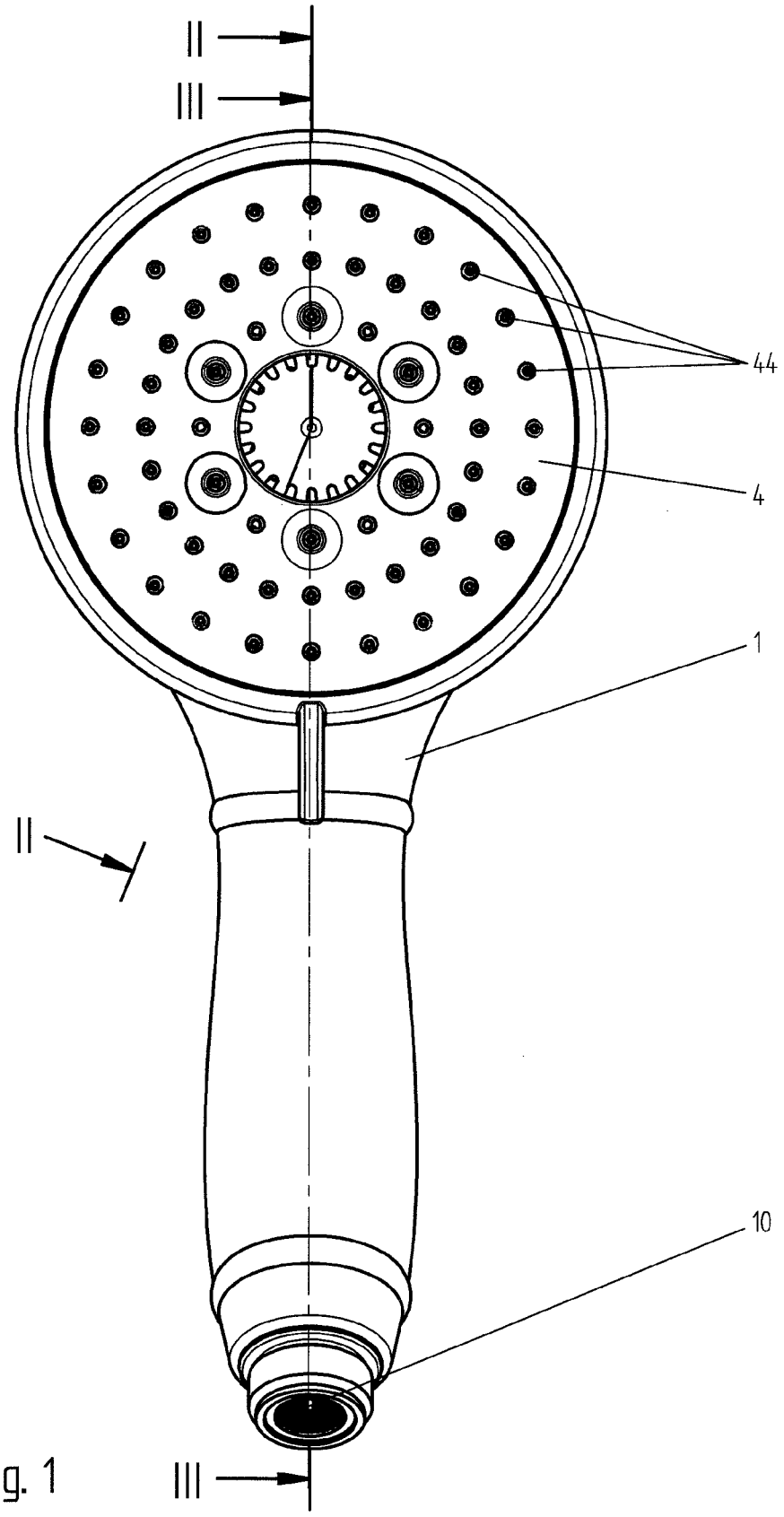
FIG. 1 shows a view of a hand shower according to an exemplary embodiment of the present invention.

In the drawing similar or corresponding elements are each provided with the same reference characters.

Figure 2:
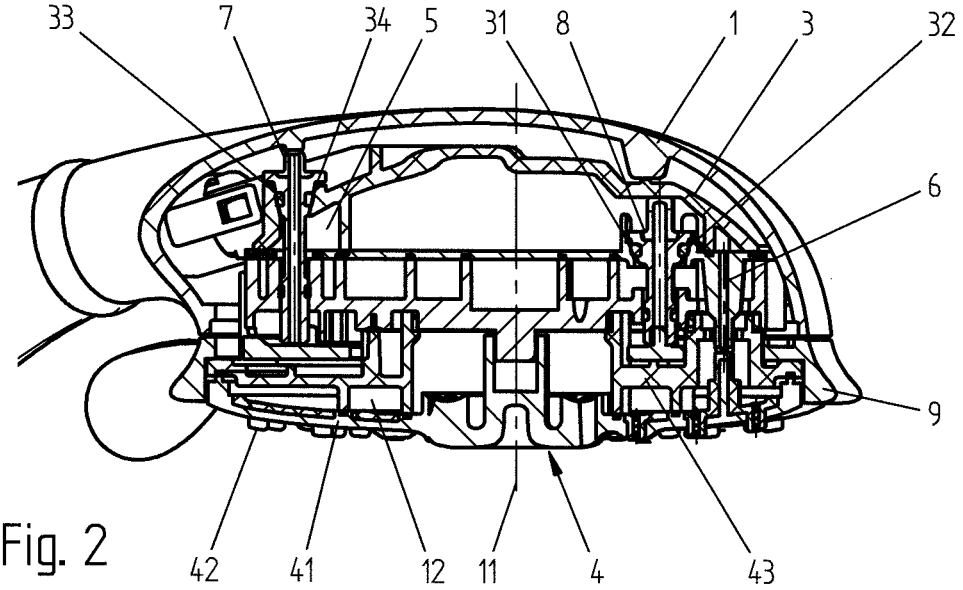
FIG. 2 shows a partial section through the hand shower of FIG. 1 along the line II-II.
Figure 3:
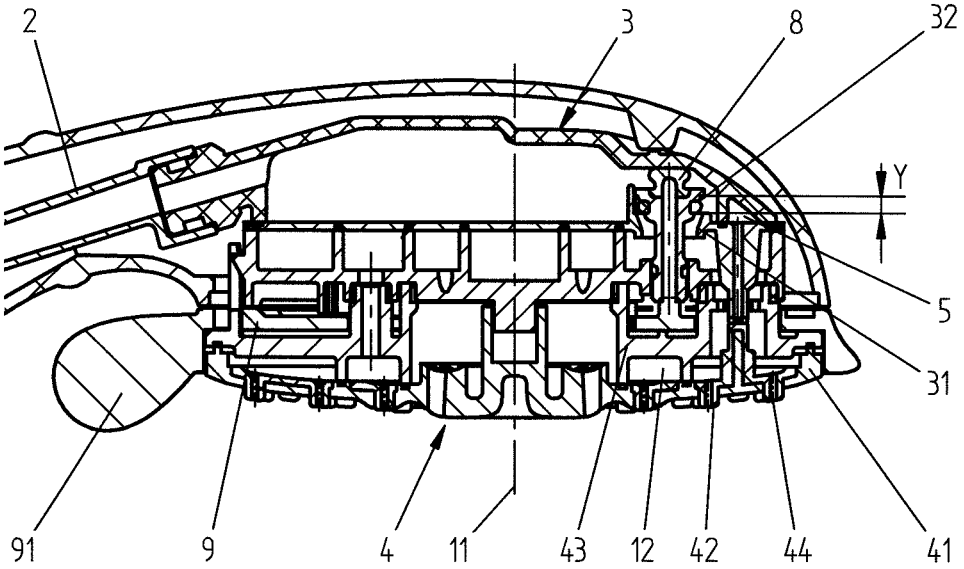
FIG. 3 shows a partial section through the hand shower of FIG. 1 along the line III-III.

FIG. 1 shows a view of hand shower. The hand shower comprises a handle and a spray head, which are connected to one another as a single piece. FIG. 2 shows a partial section through the spray head of the hand shower along the line II-II. FIG. 3 shows a partial section through the spray head of the hand shower along the line III-III. The spray head comprises a housing 1, which is connected to a handle housing. Housing 1 of the spray head is connected to a housing bottom 4, in which jet outlet openings 44 are arranged. In the present case, the hand shower has only one type of jet outlet openings 44. Housing bottom 4, which is also called the spray plate or spray base, includes several individual parts 41, 42, 43, which are combined into an assembly. The closing part of housing bottom 4 is formed by a hard outer shell 41, which is used to stabilize and shape a soft silicone mat 42, where the jet outlet nozzles are formed. The jet outlet nozzles, which pass through openings in outer shell 41, in turn have jet outlet openings 44. In the interior of the spray head, housing bottom 4 ends with a back wall 43, so that a water distribution chamber 12 is formed between outer shell 41 and back wall 43. Jet outlet openings 44 connected to water distribution chamber 12 are uniformly supplied with water via the chamber. Furthermore, at least one opening for drawing air into the spray head is provided in housing 1. In addition, the spray head has an air intake channel 6, which opens into an air channel 5. In the present example, air channel 5 is disposed as a separate channel within water guide 3.

Water enters the spray head through a water inlet 10 via a water guide 2, 3. In the present exemplary embodiment, water guide 2, 3 has a handle water guide and a head water guide, which are engaged releasably with one another. A valve opening 31 is located in water guide 3, here the head water guide, with a corresponding valve seat 32 for a valve element 8. Valve element 8 comprises a valve stem and a valve closing body, which in the closed position lies against valve seat 32.

In the present case, valve element 8 also has an elastic head unit, which functions as a spring element. Valve element 8 can move back and forth in its operating direction in a valve path (x), determined by the spring deflection of the spring element, without water being present in water guide 3. If water reaches water guide 3 through water inlet 10, in addition to the spring element, the water pressure acts on valve element 8 and presses it into the closed position against valve seat 32. In addition to first valve element 8, there is another valve element 7 whose valve seat 33 is located between air channel 5 and the outer side of water guide 3. Thus only the air supply into water guide 3 is controlled via valve element 7. The air flowing in through valve opening 34 together with the water flowing in via valve opening 31 also reaches water distribution chamber 12, which thus also serves as a mixing chamber.

A control device 9 in the form of a circular disk is disposed between spray plate 4 and the lower end of valve element 8. This is mounted rotatable about the central axis 11 of the spray head. The control device can be actuated in both rotation directions with a lever 91 formed on it.

Figure 4:
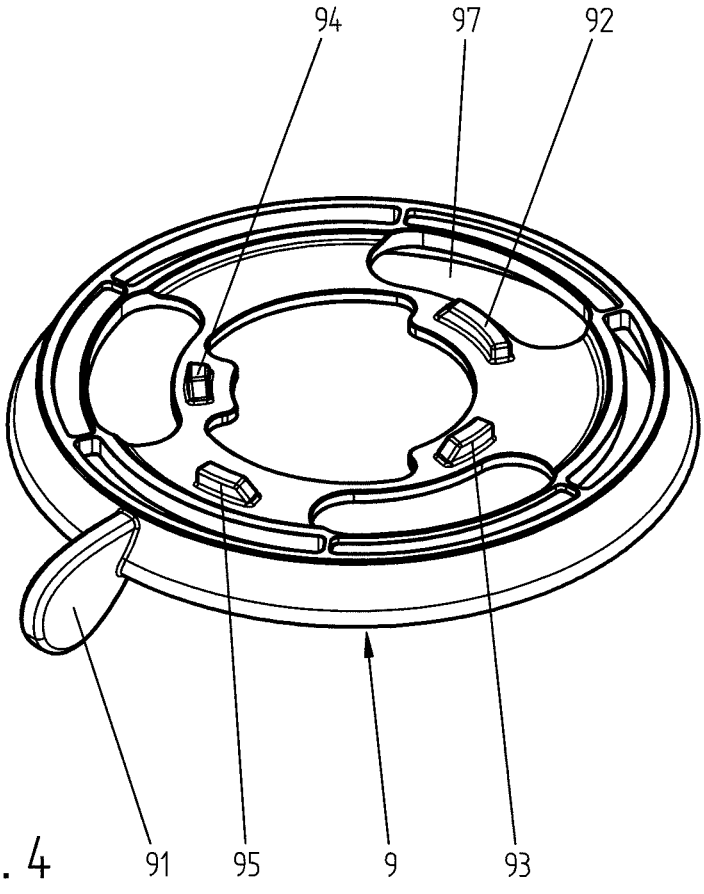
FIG. 4 shows a perspective view of a control device of the invention.

It is evident from FIG. 4 that control device 9 has a plurality of differently formed control elements 92, 93, 94, 95. These are arranged offset to one another both in the axial and in the radial direction. With a released valve opening 31, water enters water distribution chamber 12 from water guide 3 via water openings 97.

The valve positions of valve elements 7 and 8 can now be controlled via the position of control device 9 and control elements 92, 93, 94, 95 formed on the device. A group of control elements 92, 93, 94 lies on a circular path and upon rotation of the control device act on valve element 8. Another control element 95 is arranged in the radial direction offset to the other control elements 92, 93, 94 and is provided for actuating valve element 7.

As soon as the control device is positioned in such a way that no control element acts on valve element 8, the valve is in the closed position and despite the water pressure present in water guide 3 no water emerges from housing bottom 4. If control device 9, in contrast, is rotated so that, for example, control element 93 presses from below against valve element 8 and thus raises it from valve seat 32 against the present water pressure and against the spring force of the elastic element, valve opening 31 is released at least so far that a specific flow volume enters water distribution chamber 12 and thus farther to jet outlet openings 44. As becomes evident from FIG. 3 and FIG. 4, the valve lift (y) depends thereby on the control element working on the associated valve element. As a result, the valve lift (y) of a valve element 7, 8 is provided variably.

With further turning of control device 9, a blocked position is again reached first before, for example, simultaneously control element 95 acts on valve element 7 and control element 92 acts on valve element 8.

In this case, valve openings 31 and 34 are both opened, so that both air and water enter water distribution chamber 12 and are mixed there. Aerated spray jets, which have a different jet pattern than the spray jets without the air, therefore emerge from jet outlet openings 44.

With an arrangement of a plurality of separate water guides and associated jet outlet openings, the number of variants regarding the control and combination of the associated valve elements increases, so that a variety of effects can be achieved.

The invention being thus described, it will be obvious that the same may be varied in many ways. Such variations are not to be regarded as a departure from the spirit and scope of the invention, and all such modifications as would be obvious to one skilled in the art are to be included within the scope of the following claims.

What is claimed is:

1. A spray head with a housing, the spray head comprising:

a water inlet;

at least one water guide;

a housing bottom, in which jet outlet openings are arranged, the water guide being adapted as a connection between the water inlet and the jet outlet openings;

a valve element configured to seal a valve opening for the water guide, the valve element being movably mounted on both sides;

a second valve element that supplies air and is arranged in the spray head; and a control device having at least one control element acting on the valve element, the control device defining a displacement of the valve element, wherein in a first position of the control device, a surface of the at least one control element physically contacts a surface of the valve element to displace the valve element to open the valve opening, wherein in a second position of the control device, the surface of the at least one control element does not physically contact the surface of the valve element, such that the valve opening remains sealed by the valve element, and wherein the control device further includes an air control element, wherein in a third position of the control device, the air control element contacts the second valve element to displace the second valve element.

2. The spray head according to claim 1, wherein the valve element releases or closes the valve opening completely or partially depending on a position of the at least one control element.

3. The spray head according to claim 1, wherein the valve element, in a closed position, is acted on by water pressure and/or a spring element.

4. The spray head according to claim 1, wherein the valve element is controllable individually or in combination with the second valve element.

5. The spray head according to claim 1, wherein the at least one control element is a cam, a pin, a rocker lever, or a recess.

6. The spray head according to claim 1, wherein the at least one control element is arranged on the control device for a plurality of valve elements.

7. The spray head according to claim 1, wherein, per valve element, more than one control element is provided on the control device.

8. The spray head according to claim 1, wherein the at least one control element has bevels or geometric curved tracks for a continuous adjustment of the displacement of the valve element.

9. The spray head according to claim 1, wherein a disk is provided and the at least one control element protrudes from a surface of the disk so as to be arranged substantially perpendicular to a disk plane, wherein the disk and the at least one control element are provided as the control device.

10. The spray head according to claim 9, wherein the disk is rotatable about an axis arranged substantially perpendicular to the housing bottom or parallel to the valve element axis.

11. The spray head according to claim 1, wherein a disk movable in a translational manner is provided as the control device.

12. The spray head according to claim 1, wherein a circular ring or a cylindrical element with radially arranged cams is provided as the control device.

13. The spray head according to claim 1, wherein a camshaft is provided as the control device.

14. The spray head according to claim 1, wherein in the third position of the control device, one of the at least one control elements contacts the first valve element, such that both the first valve element and the second valve element are displaced.

15. The spray head according to claim 1, wherein the at least one control element moves in a different direction than the valve element.

16. A spray head with a housing, the spray head comprising:

a water inlet;

a spray plate in which jet outlet openings are arranged;

a first valve opening that supplies water to the jet outlet openings;

a first valve element configured to move between open and closed positions so as to open the first valve opening and seal the first valve opening;

a second valve opening that supplies air and a second valve element configured to move between open and closed positions so as to open the second valve opening and seal the second valve opening, and a control device having at least one first control element provided thereon, wherein in a first position of the control device, a surface of the at least one first control element physically contacts and pushes a surface of the first valve element to the open position so as to open the first valve opening, wherein in a second position of the control device, the surface of the at least one first control element is positioned apart from the surface of the first valve element, such that the first valve element is in the closed position so as to seal the first valve opening, wherein the control device further includes a second control element associated with the second valve element, and wherein in a third position of the control device, the second control element contacts and pushes the second valve element to the open position so as to open the second valve opening.

17. The spray head according to claim 16, wherein the at least one first control element moves in a different direction than the valve element.

18. The spray head according to claim 16, wherein in the third position of the control device, one of the at least one first control elements contacts the first valve element, such that both the first valve element and the second valve element are contacted and pushed into the open position.

19. The spray head according to claim 1, wherein the at least one control element and the air control element protrude from a same surface of the control device.

20. The spray head according to claim 16, wherein the at least one first control element and the second control element protrude from a same surface of the control device.

21. The spray head according to claim 16, wherein a disk is provided and the at least one first control element protrudes from a surface of the disk so as to be arranged substantially perpendicular to a disk plane, wherein the disk and the at least one first control element are provided as the control device.

22. A spray head with a housing, the spray head comprising:

a water inlet;

at least one water guide;

a housing bottom, in which jet outlet openings are arranged, the water guide being adapted as a connection between the water inlet and the jet outlet openings;

a valve element configured to seal a valve opening for the water guide, the valve element being movably mounted on both sides;

a second valve element that supplies air and is arranged in the spray head; and a rotatable control device having at least one control element fixed thereon that acts on the valve element, a rotational movement of the control device defining a linear displacement of the valve element, wherein, during rotation of the rotatable control device, the at least one control element fixed thereon is rotated from a first position in which the at least one control element displaces the valve element to open the valve opening to a second position in which the at least one control element does not displace the valve element, such that the valve opening remains sealed by the valve element, and wherein the control device further includes an air control element, wherein in a third position of the control device, the air control element contacts the second valve element to displace the second valve element.

23. The spray head according to claim 22, wherein the at least one control element has bevels for a continuous adjustment of the displacement of the valve element.

* * * * *